United States Patent [19]

Oda et al.

[11] 4,421,702

[45] Dec. 20, 1983

[54] CERAMIC RECUPERATIVE HEAT EXCHANGERS AND A METHOD FOR PRODUCING THE SAME

[75] Inventors: Isao Oda; Tadaaki Matsuhisa, both of Nagoya, Japan

[73] Assignee: NGK Insulators Ltd., Nagoya, Japan

[21] Appl. No.: 243,698

[22] Filed: Mar. 16, 1981

[30] Foreign Application Priority Data

Mar. 24, 1980 [JP] Japan ..... 55-37333

[51] Int. Cl.[3] ..... B29D 23/04

[52] U.S. Cl. ..... 264/62; 264/67; 264/209.8

[58] Field of Search ..... 264/62, 67, 209; 501/122, 8, 88, 108

[56] References Cited

U.S. PATENT DOCUMENTS

| | | | |
|---|---|---|---|
| 2,235,291 | 3/1941 | Gaertner | 264/67 |
| 3,940,301 | 2/1976 | Straw | 156/155 |
| 4,025,462 | 5/1977 | Cleveland | 252/477 R |
| 4,066,120 | 1/1978 | Mold et al. | 165/65 R |
| 4,271,110 | 6/1981 | Minjolle | 264/67 |

*Primary Examiner*—John A. Parrish

*Attorney, Agent, or Firm*—Parkhurst & Oliff

[57] ABSTRACT

Ceramic honeycomb type recuperative heat exchangers having a large number of parallel channels formed of partition walls are disclosed, in which fluids to be heat-exchanged are passed through respective channels that are produced by extruding a ceramic raw batch material into a honeycomb structural body, drying the shaped honeycomb structural body, prior to or after firing step cutting off partition walls in the given rows of the honeycomb structural body in the axial direction of the channels to a given depth from the end surface of the honeycomb structural body and sealing only the end surfaces of said rows.

5 Claims, 18 Drawing Figures

CERAMIC RECUPERATIVE HEAT EXCHANGERS AND A METHOD FOR PRODUCING THE SAME

Figure 1A:
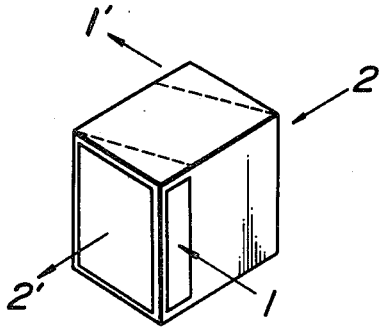

The present invention relates to ceramic recuperative heat exchangers having a large number of parallel channels formed by partition walls wherein fluids to be heat-exchanged are flowed through respective channels.

Heretofore, combustion gases exhausted from gas turbine engines, factory installations, furnaces and the like have been discharged in directly into ambient atmosphere, thereby causing problems in view of energy economy and public nuisance due to the heating or the ambient atmosphere. To obviate these problems, there have been attempts to recover the exhaust heat through a ceramic heat exchanger to thereby utilize this recovered heat. The ceramic heat exchanger includes a rotary regenerator type heat exchanger and a recuperative heat exchanger. The properties required of these heat exchangers are that the heat exchanging effectiveness be high, the pressure drop low and there be no leakage between the hot and cold fluids. The rotary regenerator type heat exchanger has a higher heat exchanging effectiveness of more than 90% but is subject to cracking owing to the mechanical and thermal stress. This is because such a heat exchanger always rotates, and the fluid consequently readily leaks from the seal portion. The recuperative heat exchanger has no driving portions, so that the leakage of fluid is relatively small but the heat transmitting area is small, so that the heat exchanging effectiveness is somewhat low. Accordingly, the development of a ceramic recuperative heat exchanger which has a high heat exchanging effectiveness and a low pressure drop, and in which the fluid scarcely leaks from the partition walls provided between the adjacent channels has been strongly desired.

Heretofore, ceramic recuperative heat exchangers have been manufactured by produding ceramic layers wherein a large number of ceramic tubes are arranged in parallel and said ceramic layers are laminated alternately so that the fluids flow in the required direction, or by alternately laminating corrugated plates formed by corrugate process and plane plates. When ceramic layers having a large number of ceramic tubes arranged in parallel are laminated, the thickness of the partition walls and the shape and size of the opening portions become nonuniform and the open frontal area is small, so that the heat transmitting area becomes small and therefore the heat exchanging effectiveness is low. When corrugated plates formed by corrugate process and plane plates are laminated alternately, the surface roughness at the inner surface of the fluid passage is high, so that the pressure drop is high. Further ceramic material itself has a low density and therefore the fluid leakage between hot and cool fluids readily occurs.

The present invention has been created to obviate these prior drawbacks and consists of a recuperative heat exchanger having a large number of parallel channels formed of partition walls in which the fluids to be heat-exchanged are moved through respective passages, wherein the sectional shape of the channels and thickness of the partition walls are substantially uniform, the open frontal area of the heat transmitting portion, where the fluids are heat-exchanged, is more than 60% and the porosity of ceramic material composing the partition walls is not more than 10%, and a method for producing the same.

The present invention will be explained in more detail below.

Figure 1B:
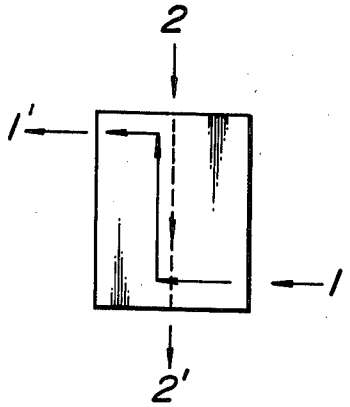
Figure 2A:
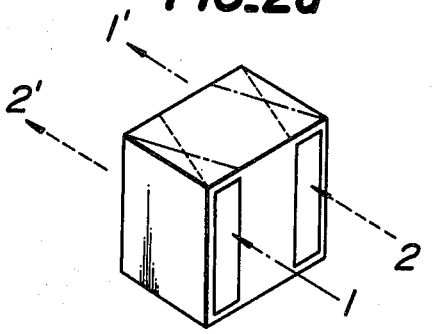
Figure 2B:
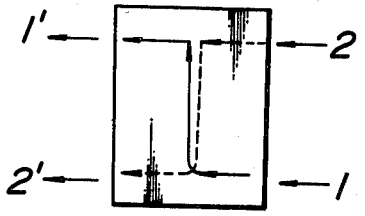
Figure 3A:
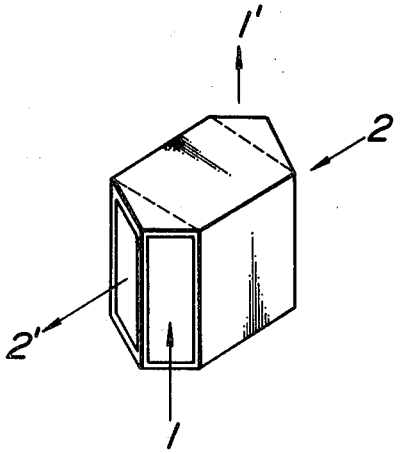
Figure 3B:
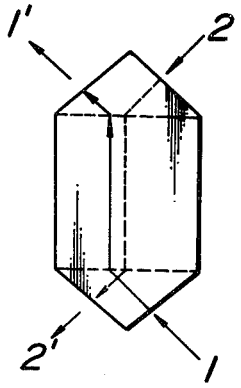
Figure 4A:
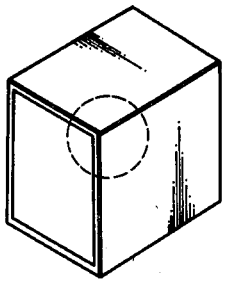
Figure 4B:
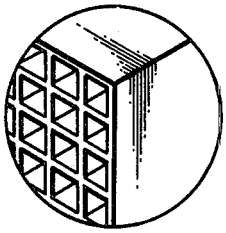
Figure 5A:
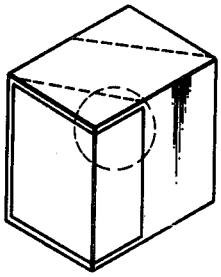
Figure 5B:
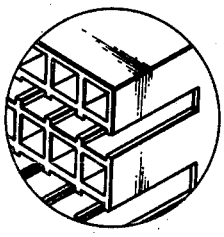
Figure 6A:
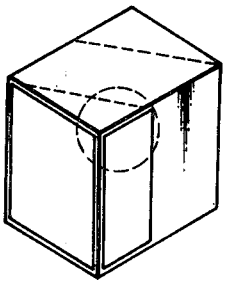
Figure 6B:
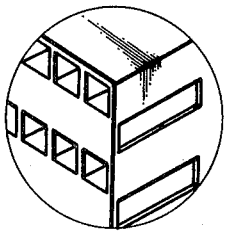
Figure 7A:
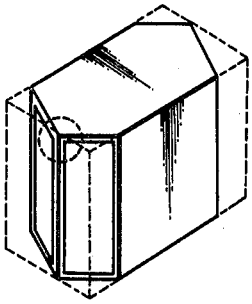
Figure 7B:
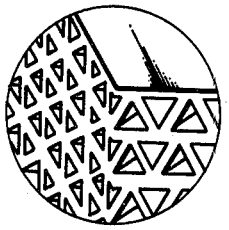
Figure 8A:
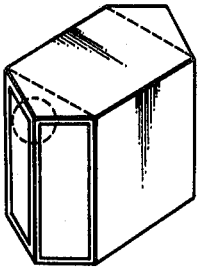
Figure 8B:
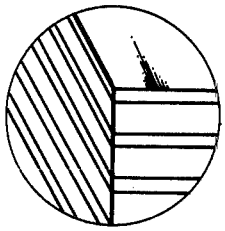
Figure 9A:
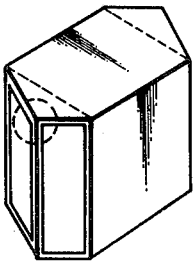
Figure 9B:
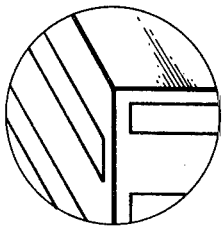

For better understanding the invention, reference is taken to the accompanying drawings, wherein:

FIGS. 1, (*a*), (*b*), FIGS. 2, (*a*), (*b*) and FIGS. 3, (*a*) and (*b*) are diagrammatic views for illustrating the principle of ceramic recuperative heat exchangers according to the present invention and schematic views showing the fluid flows respectively;

FIGS. 4, (*a*), (*b*), FIGS. 5, (*a*), (*b*) and FIGS. 6, (*a*) and (*b*) are diagrammatic views for illustrating a production method described in example 1;

FIGS. 7, (*a*), (*b*), FIGS. 8, (*a*), (*b*) and FIGS. 9, (*a*) and (*b*) are diagrammatic views for illustrating a production method described in Example 2; and (*b*) in FIGS. 4–9 is an enlarged view of the portion surrounded by the dotted line in (*a*) in FIGS. 4–9, respectively.

More detailed explanation made with respect to the ceramic recuperative heat exchanger of the present invention will now be made.

In general, the recuperative heat exchanger may include many structures in view of the position of the inlets and outlets of the hot and cool fluids and the structure of the fluid passage, but the typical embodiments capable of applying the present invention are shown in FIGS. 1–3. In these drawings, (*a*) shows the perspective views showing the principle of the ceramic recuperative heat exchangers of the present invention respectively and (*b*) shows the schematic views showing the flows of both the fluids in the heat transmitting portions. A cool fluid is introduced into the heat exchanger and 1 and discharged out at 1', while a hot fluid is introduced into the heat exchanger from 2 and discharged out at 2'. Both the fluids are heat-exchanged through the adjacent partition walls. In each drawing, the inlets and outlets of each fluid path are composed of the combination of a row where end surfaces of an elected channel row are sealed and a row where end surfaces of another channel row are opened. By varying the positions of the inlet and the outlet, the structure of the ceramic heat exchanger may be varied but the structure at the heat transmitting portion where the heat exchange is carried out, is generally shown by one of FIG. 1, FIG. 2 and FIG. 3.

As ceramic materials to be used in the present invention, materials having high heat resistance and thermal shock resistance are preferable for effectively utilizing the heat exchange of the hot fluid. Ceramic materials having low thermal expansion, such as cordierite, mullite, magnesium aluminum titanate, silicon carbide, silicon nitride and a combination of these materials are desirable. These materials are excellent in heat resistance and are small in thermal expansion coefficient as shown in the following table, so that these materials can endure rapid temperature change. They are therefore most preferable as the materials for forming the recuperator where hot and cool fluids are flowed adjacently and heat-exchanged through the partition walls.

| Ceramic material | Melting point | Thermal expansion coefficient |
|---|---|---|
| Cordierite | 1,460° C. | $2.0 \times 10^{-6}$/°C. |
| Mullite | 1,810° C. | $4.5 \times 10^{-6}$/°C. |
| Magnesium aluminum titanate | 1,700° C. | $1.0 \times 10^{-6}$/°C. |
| Silicon carbide | 2,700° C. (decomposition) | $4.5 \times 10^{-6}$/°C. |

-continued

| Ceramic material | Melting point | Thermal expansion coefficient |
|---|---|---|
| Silicon nitride | 1,900° C. (decomposition) | $3.2 \times 10^{-6}$/°C. |

The sectional cellular shape to be used in the present invention may be any shape, as long as said shape can be formed by extrusion. Triangular, quadrilateral or hexagonal shapes are preferable.

An explanation will now be made with respect to a method for producing ceramic recuperative heat exchangers according to the present invention.

Ceramic materials, water and/or an organic solvent and a forming aid are mixed thoroughly in given amounts to prepare a raw batch mixture. This mixture is passed through a screen, if necessary and then extruded through an extrusion die by which the sectional shape of the channels becomes triangular, quadrilateral or hexagonal to prepare a honeycomb structural body having a large number of axially parallel channels. The extrusion molding may be carried out, for example by the method described in Benbow et al., U.S. Pat. No. 3,824,196.

After the shaped body is dried, prior to or after the firing step, partition walls in the given rows of the honeycomb structural body are cut off in axial direction of the channels to a given depth from the end surface. Thereafter, only the end surfaces of the channels in said rows are sealed with a sealing material to form a ceramic recuperative heat exchanger according to the present invention. The term "end surfaces" of a honeycomb structural body means the surfaces formed by cutting the shaped honeycomb structure in the plane perpendicular to the axial direction of the channels.

Among the production steps of the present invention, the processing applied to the honeycomb structural body prior to or after the firing step is different depending upon the structure of the recuperative heat exchanger, but in general the method comprises a step of forming a passage for one of fluids by cutting partition walls in the given rows of the honeycomb structural body in the axial direction of the channels to a given depth from the end surface of the honeycomb structural body to form a passage of one of the fluids and a step for sealing only the end surfaces in the extrusion direction of the channels among the cut surfaces to a given depth with a same material as the honeycomb matrix or a material having similar properties to the honeycomb matrix.

The following examples are given for the purpose of illustration of the present invention and are not intended as limitations thereof.

EXAMPLE 1

To 100 parts by weight of cordierite were added 37 parts by weight of water, 4 parts by weight of methylcellulose as a forming aid and 3 parts by weight of a surfactant and the resulting mixture was kneaded for 1 hours by means of a kneader and the mixture was passed through a screen having a mesh of 149 μm to prepare a raw batch material. This raw batch material was extruded through a die by which the sectional shape of the channels becomes quadrangle, to obtain a ceramic segment having a wall thickness of 0.17 mm and a cell pitch of 1.4 mm. The shaped ceramic segment was subsequently dried to obtain the honeycomb structure body shown in FIG. 4. Then, partition walls of the channels in alternate rows of the honeycomb structural body were cut off in the axial direction of the channels to 20 mm at the deepest portion from the end surfaces of the honeycomb structural body as shown in the broken lines in FIG. 5. This cutting was accomplished by means of a 0.5 mm diamond cutter and then cordierite paste was injected into only the end surfaces in the extrusion direction of the channels to a depth of 1 mm to seal the end surfaces of the cut honeycomb structural body, whereby the ceramic recuperative heat exchanger as shown in FIG. 6 was obtained. The step for sealing the end surfaces of the channels wherein the partition walls are cut as described above, may be attained by applying a cordierite ceramic sheet having a thickness of about 1 mm, which has been previously separately prepared, to the cut end surfaces of the honeycomb structural body. The thus formed honeycomb structural body was fired at 1,400° C. in an electric furnace for 5 hours to obtain a ceramic recuperative heat exchanger. The formed ceramic recuperative heat exchanger was composed of channels having a sectional shape of a uniform quadrangle and a uniform wall thickness of 0.14 mm. The open frontal area of the heat transmitting portion where the fluids are heat-exchanged, was 77% and the porosity of the ceramic material to be used for the partition walls was 3%. When the leakage of air was measured by sealing one end of this ceramic recuperative heat exchanger and introducing compressed air from another end, the leakage was less than 0.1%.

EXAMPLE 2

To 100 parts by weight of SiC powder of grain size of less than 10 μm were added 2 parts by weight of boron and 2 parts by weight of carbon, which are densing assistants, and 10 parts by weight of vinyl acetate as a forming aid and 25 parts by weight of water. The mixture was thoroughly kneaded to prepare a raw batch material for extrusion. The obtained batch material was extruded through a die by which the sectional shape of the channels became triangular, to obtain a honeycomb structural body having a large number of axially extended channels in which the sectional cell shape is a regular triangle having one side of 1.88 mm and the wall thickness is 0.3 mm. This honeycomb structural body was cut as shown in FIG. 7 in both the sides from the center of the cell surface in an angle of 45° and then as shown in FIG. 8, the partition walls of the channels in each row were cut off to the portions shown by the broken lines from both the end surfaces. The cut surfaces of the channels in the given rows at both the ends in the axial direction of the honeycomb structural body were sealed with previously prepared SiC film having a thickness of 1 mm so that the inlet and the outlet of one of the fluids position on a diagonal of the honeycomb structural body and the sealed surfaces are arranged in the alternate row. The thus treated honeycomb structural body was fired in argon atmosphere at 2,000° C. for 1 hour to obtain a silicon carbide recuperative heat exchanger. The sectional shape of the channels in which the respective fluids flow, was substantially a uniform regular triangle the wall thickness was a uniform 0.24 mm, and the open frontal area of the heat transmitting portion where the fluids are mainly heat-exchanged, was 61% and the porosity of the ceramic material used for the partition walls was 8%. By using this ceramic recuperator and using combustion gas at 800° C. as a hot fluid and air at 150° C. as a cool fluid, the heat exchanging effectiveness was measured and said efficiency was 90%.

As seen from the above described explanation, in ceramic recuperative heat exchangers according to the present invention, the open frontal area of the portion where the heat exchange of fluids is carried out is as large or longer than 60%, so that the heat exchanging effectiveness is excellent and the pressure drop is small. That is, prior ceramic recuperative heat exchangers are a ceramic layer wherein a large number of tubes are arranged or a laminate in which corrugate plates formed by corrugate process and plane plates are laminated, so that the open frontal area of the portion where the fluids are heat-exchanged, is less than 60%, so that the heat exchanging effectiveness is low and the pressure drop is large. On the contrary the recuperators according to the present invention are produced by extrusion, so that the passage of the fluids, the sectional shape of the channels and the thickness of the partition walls are uniform the inner surface of the channels is smooth and the partition walls can be made thin and dense, so that the open frontal area can be enlarged. Accordingly, the heat exchanging effectiveness is higher the pressure drop is lower and the leakage between the hot and cool fluids is quite small.

Thus, the ceramic recuperative heat exchangers according to the present invention are very useful as heat exchangers for gas turbine engines and industrial furnaces.

What is claimed is:

1. A method for producing ceramic recuperative heat exchangers having a large number of parallel channels formed of partition walls such that flowing fluids are capable of being heat-exchanged through respective channels, in which the sectional shape of the channels and thickness of the partition walls are substantially uniform, the open frontal area of the heat transmitting portion where the fluids are heat-exchanged being more than 60% and the porosity of the ceramic material forming the partition walls simultaneously being not more than 10%, which comprises: adding to ceramic material at least some water, an organic solvent, and a forming aid, kneading thoroughly the resulting mixture to prepare a raw batch material; extruding the raw batch material into a honeycomb structural body having a large number of axially extended channels in which the sectional shape of the channels and the thickness of the partition walls are substantially uniform, the channels being arranged generally into rows; drying the shaped honeycomb structural body; prior to or after firing, cutting off partition walls in particular rows of the honeycomb structural body in the axial direction of the channels to a given depth from the end surface of the honeycomb structural body; and sealing only the end surfaces of said rows with a suitable sealing means, such that the open frontal area of the heat transmitting portion is at least 60%, and the porosity of the ceramic is no more than 10% after the conclusion of said sealing step.

2. The method as claimed in claim 1 wherein the step of sealing the end surfaces of said rows when the partition walls have been cut off, comprises applying a paste of the same material as the honeycomb structural body.

3. The method as claimed in claims 1 or 2, wherein the sectional shape of the channels is triangular, quadrilateral or hexagonal.

4. The method as claimed in claim 1 or 2 wherein the ceramic material is cordierite, mullite, magnesium aluminum titanate, silicon carbide or silicon nitride.

5. The method as claimed in claim 3, wherein the ceramic material is cordierite mullite, magnesium aluminum titanate, silicon nitride.

* * * * *